US005322364A

United States Patent [19]

Kasparbauer, Jr.

[11] Patent Number: 5,322,364

[45] Date of Patent: Jun. 21, 1994

[54] ORNAMENTAL PLASTIC PART

[76] Inventor: Paul H. Kasparbauer, Jr., P.O. Box 81, Templeton, Iowa 51463

[21] Appl. No.: 975,690

[22] Filed: Nov. 12, 1992

[51] Int. Cl.[5] ..... A47B 97/00

[52] U.S. Cl. ..... 312/204; 312/238

[58] Field of Search ..... 312/238, 204; D6/434, D6/491, 509

[56] References Cited

U.S. PATENT DOCUMENTS

| | | | |
|---|---|---|---|
| D. 63,142 | 10/1923 | Frank | D6/491 X |
| D. 318,587 | 7/1991 | Keller | D6/491 |
| 3,961,456 | 6/1976 | Manlove et al. | 312/204 X |

*Primary Examiner*—Timothy V. Eley

*Assistant Examiner*—Khan V. Nguyen

*Attorney, Agent, or Firm*—Zarley, McKee, Thomte, Voorhees & Sease

[57] ABSTRACT

An ornamental molded plastic part includes a generally semicircular arch-shaped forward panel with a hollow generally quarterspherical main body portion extending rearwardly from the forward panel and ending in a generally vertical semicircular rear panel. The forward panel has a plurality of semicircular cut-outs uniformly spaced along the lower edge, with a plurality of flutes extending from the cut-outs and along the interior surface of the main body to the rearward panel. The flutes have a generally semicircular cross-section which decreases in radius from the forward panel to the rearward panel.

6 Claims, 3 Drawing Sheets

ORNAMENTAL PLASTIC PART

TECHNICAL FIELD

The present invention relates to the molding of plastic parts, and more particularly to an ornamental cockleshell-shaped piece and method for manufacturing the same.

BACKGROUND OF THE INVENTION

Antique furniture pieces typically utilized many intricate shapes, requiring hand carving and other skills. One particular piece found in many cabinets is known as a cockleshell. This shape is formed from a generally hollow quartersphere with tapering flutes carved therein.

Originally, the cockleshell shape was created by forming a blank by gluing a plurality of arch-shaped wood pieces together to form a generally quartersphere shape. The flutes were then hand carved into the blank to form the finished product.

Since the origination of the cockleshell carving, various shortcuts in forming a wood cockleshell have been improvised. For example, one method for manufacturing the cockleshell without the need for hand carving utilizes a jig and router for forming the flutes. However, all of these methods still require labor intensive work on laminated wood.

It is therefore a general object of the present invention to provide a plastic cockleshell cabinet top.

Another object of the present invention is to provide a method for manufacturing a cockleshell shape out of plastic to simulate conventional wood cockleshells.

These and other objects will be apparent to those skilled in the art.

SUMMARY OF THE INVENTION

The ornamental molded plastic part of the present invention includes a generally semicircular arch-shaped forward panel with a hollow generally quarterspherical main body portion extending rearwardly from the forward panel and ending in a generally vertical semicircular rear panel. The forward panel has a plurality of semicircular cut-outs uniformly spaced along the lower edge, with a plurality of flutes extending from the cut-outs and along the interior surface of the main body to the rearward panel. The flutes have a generally semicircular cross-section which decreases in radius from the forward panel to the rearward panel. The rear panel preferably has a plurality of flutes formed therein in a general fan shape. A continuous arcuate channel is formed along the lower edge of the forward panel and continues along the cut-outs therein, with a generally quartercircular cross-section. The method for forming the ornamental plastic part includes the steps of providing a mold with ornamentation for forming the above-described ornamental part. The exterior surface of the mold is then cleaned and dried, and then a coat of wax is applied and polished. A mold release agent is sprayed on the exterior surface of the mold and then a plurality of uniform coats of liquid plastic are sprayed on the mold to form the molded part. Once the molded part has set and dried, it is released from the mold by pulling on the plastic part and flexing the part to release the ornamentation from the mold.

DESCRIPTION OF THE PREFERRED EMBODIMENTS

Figure 1:
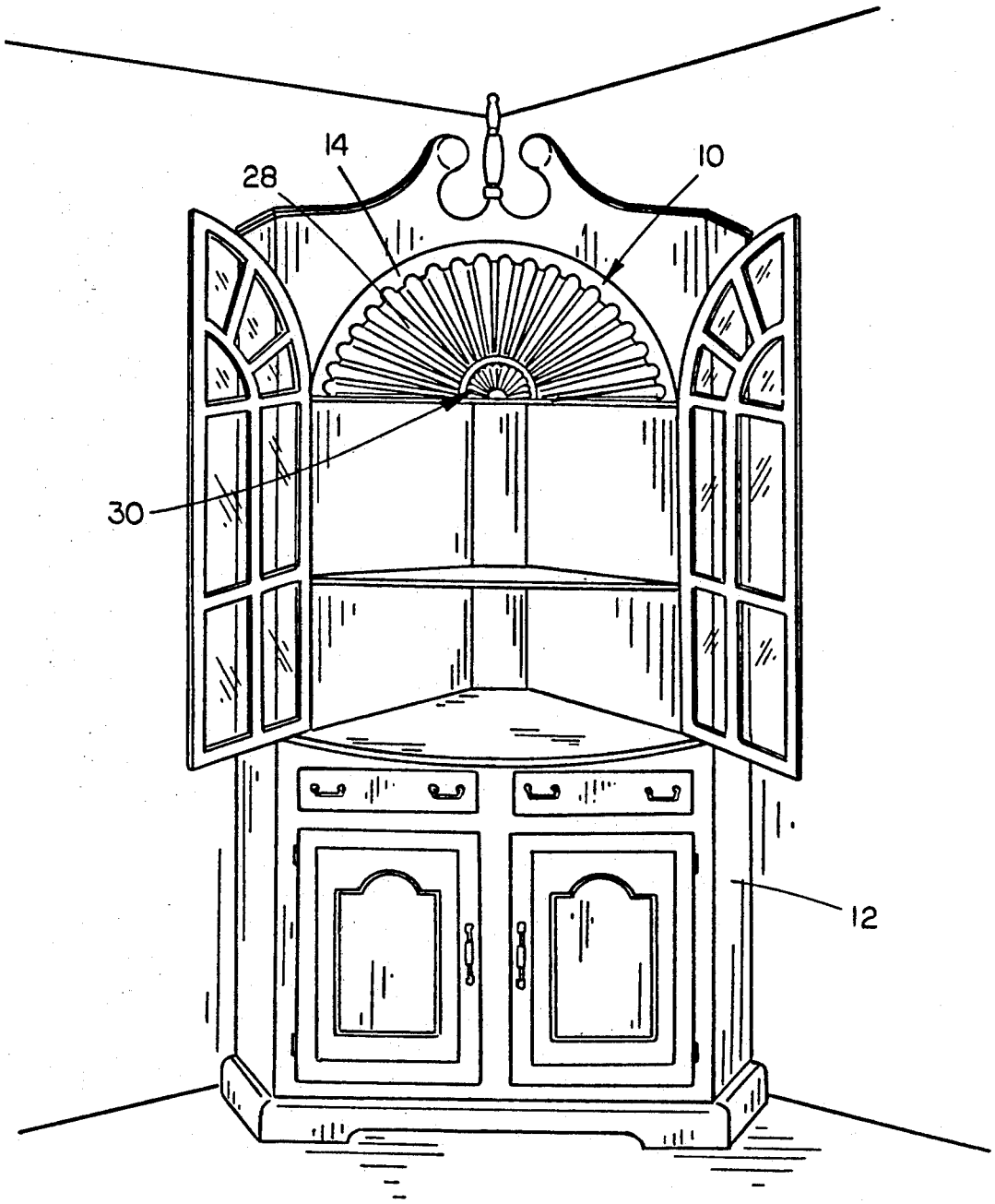
FIG. 1 is a perspective view of a cockleshell of the present invention installed in a cabinet.

Referring now to the drawings, in which similar or corresponding parts are identified with the same reference numeral, and more particularly to FIG. 1, the plastic cockleshell of the present invention is identified generally ar 10 and is shown installed in the top of a corner cabinet 12.

Figure 3:
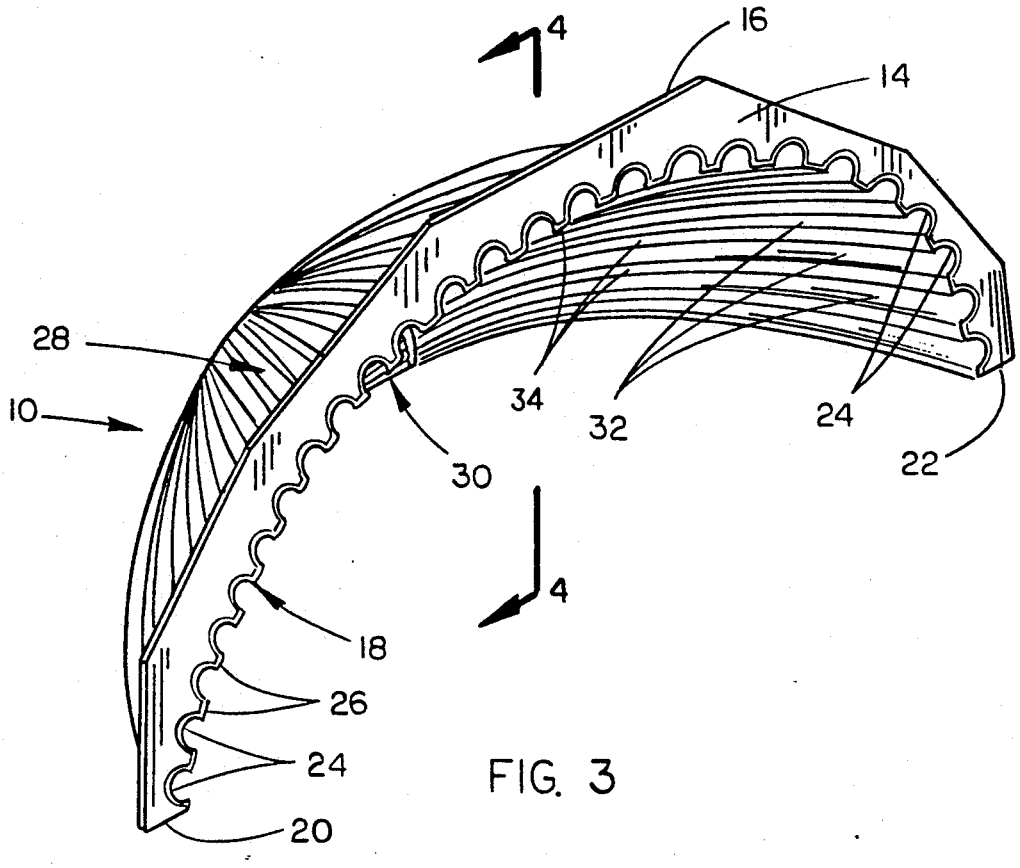
FIG. 3 is a forward perspective view of a plastic cockleshell of the present invention.
Figure 4:
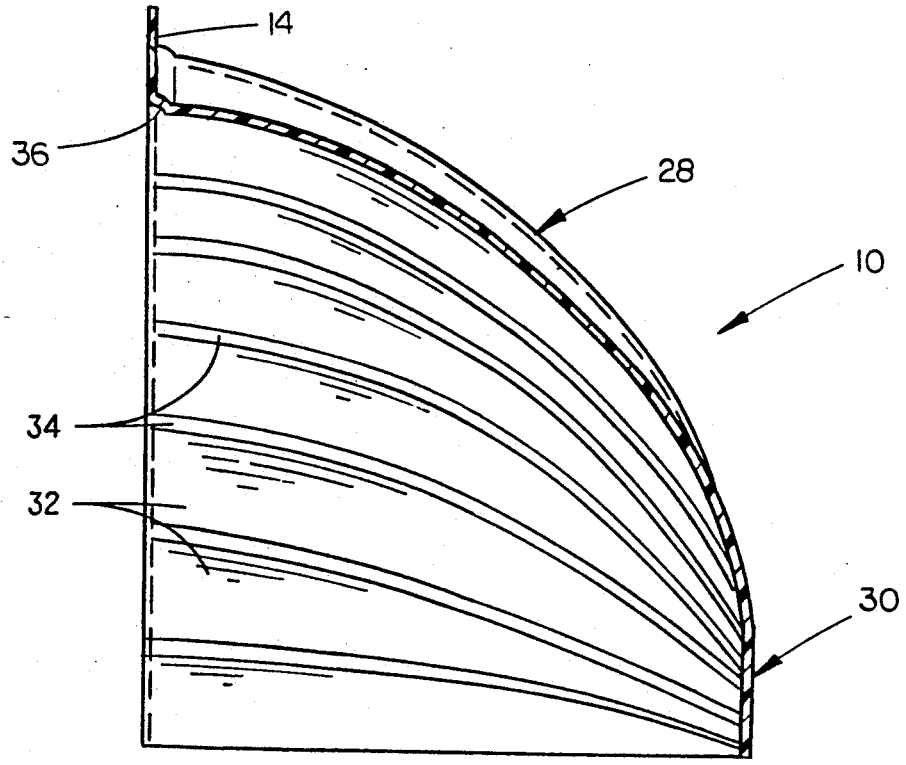
FIG. 4 is a sectional view taken at lines 4—4 in FIG. 3.

Referring now to FIGS. 3 and 4, cockleshell 10 is a molded plastic part having a generally flat planar forward mounting panel 14 having a generally semicircular arch shape in front elevation. Panel 14 includes an upper edge 16 and lower edge 18 which are connected at side edges 20 and 22 respectively.

The lower edge 18 of front panel 14 is generally semicircular in shape, with a plurality of semicircular cut-outs 24 formed therealong and directed radially outwardly towards the upper edge of panel 14. Cut-outs 24 are uniformly spaced along lower edge 18 and are separated by generally flat ridges 26.

Cockleshell 10 includes a main body 28 which extends rearwardly from forward mounting panel 14 in the general shape of a hollow quartersphere. A generally flat semicircular rear panel 30 forms the rearward most portion of main body 28 and has a plurality of flutes formed therein in a general fan shape, as shown in FIG. 1. Cut-outs 24 form the forward end of a plurality of flutes 32 which extend rearwardly along the inner surface of main body 28 to rear panel 30. Flutes 32 have a generally semicircular cross-section which decreases in radius from cut-outs 24 to rear panel 30. Flutes 32 are separated by a generally flat ridge 34 which extends from forward panel 14 rearwardly to rear panel 30.

An arcuate channel or flare 36 is formed along the extent of lower edge 18 of forward mounting panel 14, and extends continuously along cut-outs 24 and ridges 26. As shown in FIG. 4, flare 36 is preferably in the general shape of quarter circle.

Figure 2:
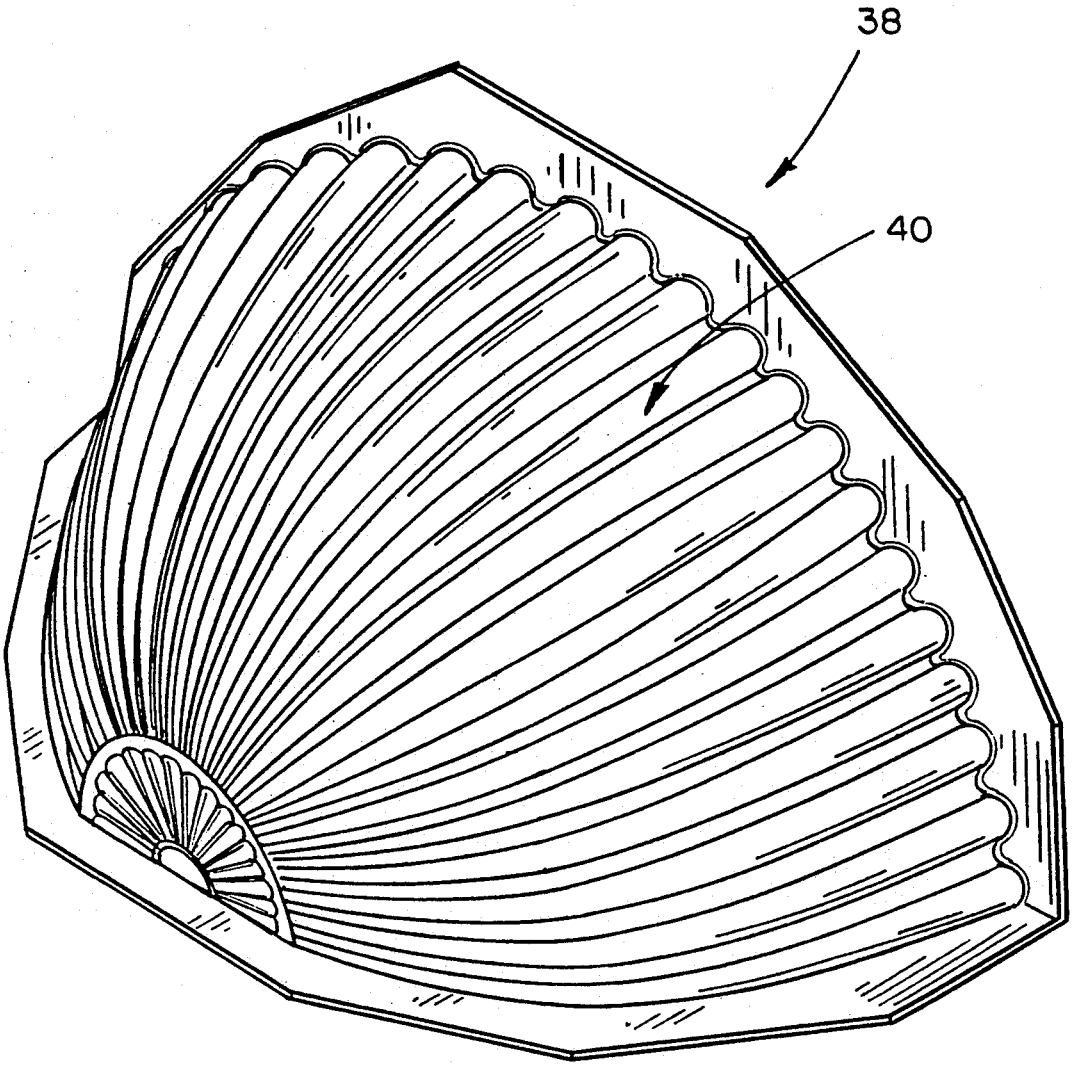
FIG. 2 is a rearward perspective view of a mold utilized in forming a plastic cockleshell of the present invention.

Referring now to FIG. 2, a mold 38 is shown which is utilized to produce the cockleshell 10 described in FIGS. 1, 3 and 4. Since the interior surface of cockleshell 10 is the portion which will be displayed, the upper/exterior surface 40 of mold 38 is formed in a shape which will produce the described sunburst on rear panel 30, flutes 32, ridges 34 and flare 36 on the main body 28 of cockleshell 10. Thus, mold 38 includes inverse surfaces which correspond directly with the desired surfaces of cockleshell 10.

In order to form cockleshell 10, the exterior surfaces 40 of mold 38 are first thoroughly cleaned and dried. A coat of wax is then applied to exterior surface 40 and polished. A second coat of wax is applied to mold 38 and polished. A conventional mold release is then sprayed on exterior surfaces 40 to assist in removing the molded part from mold 38.

The plastic utilized to form cockleshell 10 must be sturdy, yet resilient and flexible to permit release from the mold without damage to the molded part. The preferred material is formed of fifty percent urethane and fifty percent resin, and applied as a spray to mold 38. Three coats of this material are applied to the mold, each coat being permitted to set and dry before the application of a subsequent coat. Preferably, the final part has a thickness of about one-quarter inch, to provide the necessary strength, yet allow flexibility to permit the part to be released from the mold. The resilient flexibility of the molded part is necessary to release the part from the mold, since the fluted quarterspherical shape of the mold requires slight bending of the part to release the fluting from the mold 38. This procedure is then repeated for each clam shell 10 to be produced.

Whereas the invention has been shown and described in connection with the preferred embodiment thereof, it will be understood that many modifications, substitutions and additions may be made which are within the intended broad scope of the appended claims. There has therefore been shown and described a plastic clam shell part and method for making the same.

We claim:

1. An ornamental part molded from resilient, flexible plastic material, including:

a vertical, generally semicircular arch-shaped forward panel having an upper arch-shaped edge and a lower arch-shaped edge, a forward surface and a rearward surface;

a main body portion extending rearwardly from the forward panel, in the general shape of a hollow quartersphere having an interior surface and an exterior surface;

a generally vertical semicircular rear panel formed at the rearward end of the main body, having a forward, interiorly directed surface and a rearward, exteriorly directed surface;

a plurality of generally semicircular cut-outs uniformly spaced along said forward panel lower edge;

a plurality of flutes having a generally semicircular cross-section, formed on the interior surface of said quartersphere and extending from each said cut-out rearwardly to said rear panel, to form a general cockleshell shape; and a continuous arcuate channel formed along the lower edge of said forward panel, including said cut-outs and ridges.

2. The ornamental plastic part of claim 1, wherein said channel has a generally quarter circular cross-section.

3. An ornamental part molded from resilient, flexible plastic material, including:

a vertical, generally semicircular arch-shaped forward panel having an upper arch-shaped edge and a lower arch-shaped edge, a forward surface and a rearward surface;

a main body portion extending rearwardly from the forward panel, in the general shape of a hollow quartersphere having an interior surface and an exterior surface;

a generally vertical semicircular rear panel formed at the rearward end of the main body, having a forward, interiorly directed surface and a rearward, exteriorly directed surface;

a plurality of generally semicircular cut-outs uniformly spaced along said forward panel lower edge;

a plurality of flutes having a generally semicircular cross-section, formed on the interior surface of said quartersphere and extending from each said cut-out rearwardly to said rear panel, to form a general cockleshell shape; and a continuous arcuate channel formed along the lower edge of said forward panel, including said cut-outs and ridges; and said flutes having a cross-sectional radius which decreases, from the forward panel to the rearward panel.

4. The ornamental plastic part of claim 3, wherein said flutes are separated by a generally flat ridge extending from said front panel to said rear panel, said ridges having a width, as measured from flute to flute, which decreases from the forward panel to the rearward panel.

5. The ornamental plastic part of claim 3, further comprising a plurality of flutes formed in the forward surface of said rear panel, arranged in a general fan shape.

6. An ornamental part molded from resilient, flexible plastic material, including:

a vertical, generally semicircular arch-shaped forward panel having an upper arch-shaped edge and a lower arch-shaped edge, a forward surface and a rearward surface;

a main body portion extending rearwardly from the forward panel, in the general shape of a hollow quartersphere having an interior surface and an exterior surface;

a generally vertical semicircular rear panel formed at the rearward end of the main body, having a forward, interiorly directed surface and a rearward, exteriorly directed surface;

a plurality of generally semicircular cut-outs uniformly spaced along said forward panel lower edge;

a plurality of flutes having a generally semicircular cross-section, formed on the interior surface of said quartersphere and extending from each said cut-out rearwardly to said rear panel, to form a general cockleshell shape; and a continuous arcuate channel formed along the lower edge of said forward panel, including said cut-outs and ridges; and said flutes being separated by a generally flat ridge extending from said front panel to said rear panel.

* * * * *